United States Patent [19]

Shand et al.

[11] Patent Number: 4,639,704

[45] Date of Patent: Jan. 27, 1987

[54] DEBRIS TOLERANT SOLENOID

[75] Inventors: J. Richard Shand, Middlebury; Raymond H. LaChance, Canaan, both of Conn.

[73] Assignee: Bicron Electronics Company, Canaan, Conn.

[21] Appl. No.: 835,684

[22] Filed: Mar. 3, 1986

[51] Int. Cl.[4] ..... H01F 7/08

[52] U.S. Cl. ..... 335/255; 335/260; 251/129.21

[58] Field of Search ..... 335/255, 257, 258, 260, 335/278; 251/129.18, 129.21

[56] References Cited

U.S. PATENT DOCUMENTS

| | | | |
|---|---|---|---|
| 2,931,617 | 4/1960 | Jamieson | 335/257 |
| 3,103,612 | 9/1963 | Marmo | 335/257 X |
| 4,166,262 | 8/1979 | Jencke et al. | 335/262 X |

*Primary Examiner*—George Harris

*Attorney, Agent, or Firm*—William C. Crutcher

[57] ABSTRACT

A solenoid designed to operate immersed in a fluid containing magnetic particles of debris, and having a movable armature slidable toward and away from a fixed core within a bobbin carrying the electromagnetic coil. The bobbin is provided with internal flutes defining longitudinal passages opening at both ends of the solenoid for conducting magnetic particles or debris out through the passages as the solenoid armature moves toward the core.

6 Claims, 4 Drawing Figures

DEBRIS TOLERANT SOLENOID

BACKGROUND OF THE INVENTION

This invention relates generally to electromagnetic solenoids intended to operate immersed in a fluid containing debris or magnetic particles, and more particularly to an improved low cost DC solenoid suitable for use immersed in oil or other liquids.

One use of a immersed solenoid is to shut off the flow of fuel in a diesel type internal combustion engine. The most effective location for the solenoid is inside the fuel injection pump. Locating the solenoid inside simplifies the design of the pump. However, when the solenoid is located inside the pump, it operates directly in the diesel fuel. Because of the magnetic field associated with a DC solenoid, ferrous particles in the fuel oil are attracted to the surfaces of the solenoid by the magnetic field. The contamination often builds up and mechanically prohibits the electric shut off solenoid from either opening or closing properly.

Solenoids designed to operate immersed in a fluid such as diesel oil containing debris or magnetic particles are also suseptible to loss of efficiency due to migration of debris or magnetic particles into the clearance space between the movable armature and core of the solenoid. The problem is particularly acute with a DC solenoid, since magnetic particles tend to accumulate and build up in the clearance spaces.

One prior art approach was to employ a smooth cylindrical armature sliding with close clearances within a smooth brass sleeve inside the bobbin, and to provide a sliding felt washer seal around the armature plunger in order to prevent entry of the debris or magnetic particles. While this has been partially successful, the felt washer and brass sleeve represent additional cost in material and labor, loss of efficiency because of friction with the armature, loss of sealing over the life of the solenoid because of wear of the washer, and a possibility of malfunction of the solenoid due to jamming action of the felt washer with the armature.

Solenoids are known of the type which operate fluid valves and permit the controlled fluid to flow through longitudinal grooves around the magnetic armature, such constructions being shown in U.S. Pat. No. 1,504,773 to Marston, 2,607,368 to Mayer, and 2,614,584 to Geopfrich. This type of solenoid requires a pressurized flow of fluid from one end of the solenoid armature to the other in order to conduct the fluid to the valve opening. In U.S. Pat. No. 4,518,938 to Bartholomaus et al., an armature with external longitudinal grooves slides within a low friction sleeve having a synthetic plastic material coating. Flow through the longitudinal grooves in the armature is due to pressure difference across the armature.

It would be desirable to provide a solenoid designed for fluid immersion which is tolerant to magnetic particles and other debris in the fluid.

Accordingly, one object of the present invention is to provide an improved low cost solenoid designed for operation immersed in a fluid containing contaminating debris and magnetic particles.

Another object of the invention is to provide an improved low cost solenoid for use inside a diesel fuel injection pump.

DRAWINGS

The invention, both as to organization and method of practice, together with other objects and advantages thereof, will best be understood by reference to the following description, taken in connection with the accompanying drawings, in which:

FIG. 1 is a horizontal elevation view, partly in section of the improved electromagnetic solenoid according to the present invention, FIG. 2 is a cross-section taken along lines II—II of FIG. 1, FIG. 3 is a perspective drawing of the improved fluted bobbin used in the present invention, and FIG. 4 is a fragmentary cross-sectional view of a modified form of the stationary core.

SUMMARY OF THE INVENTION

Briefly stated, the invention is practiced by providing, in an electromagnetic solenoid of a known type including a nonmagnetic bobbin wound with a coil, a frame of magnetic material carrying the bobbin and coil, a stationary magnetic core piece attached to the frame and extending partially through the interior of the bobbin, and a movable armature adapted to slide to and from the core piece from the other end of the bobbin; the improvement comprising the provision of longitudinal, circumferentially spaced, flutes around the interior of the bobbin, defining longitudinal passages open at either end thereof, and arranged to provide for flushing of contaminating particles and debris out through the longitudinal passages between flutes when the armature moves toward the core piece.

DESCRIPTION OF THE PREFERRED EMBODIMENT

Figure 1:
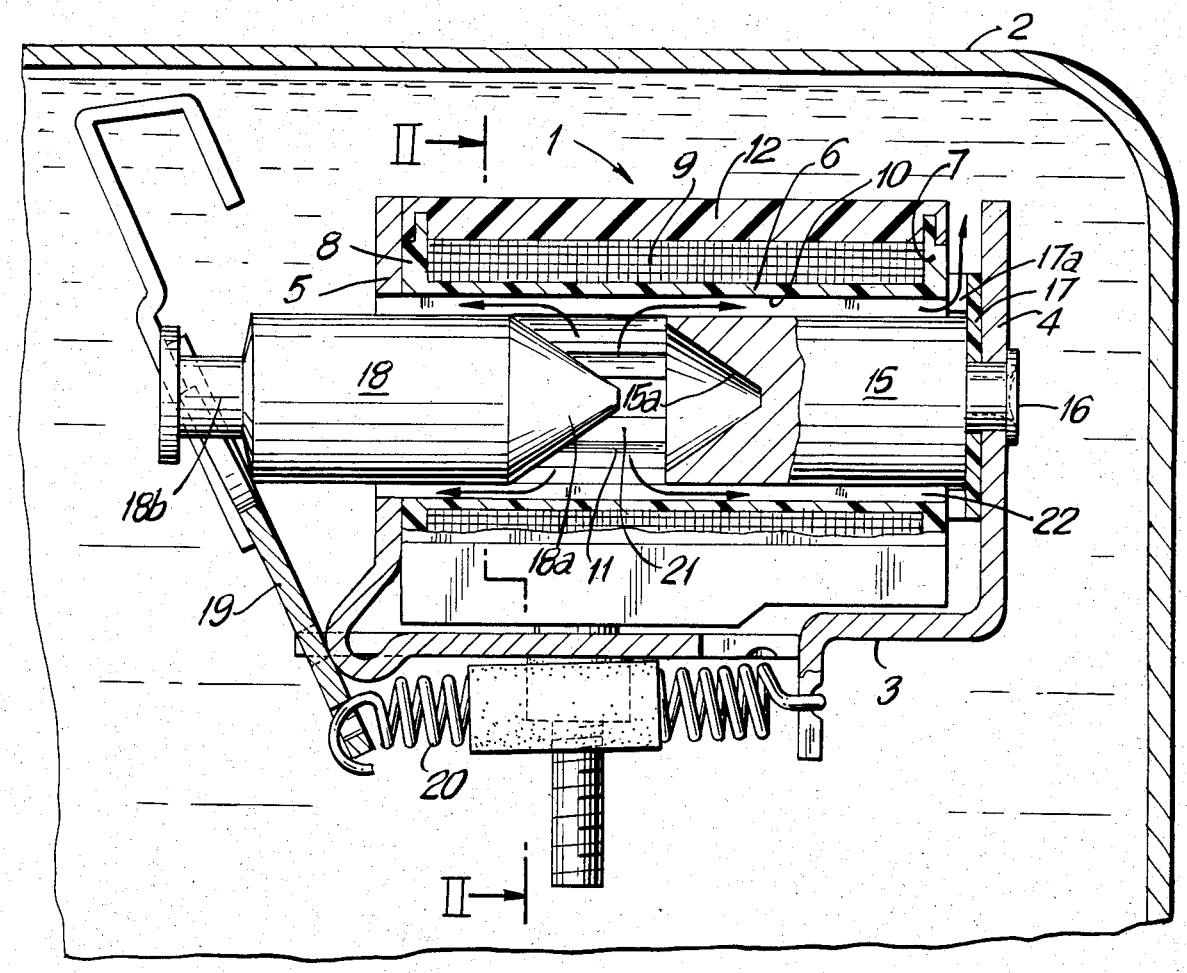
Figure 3:
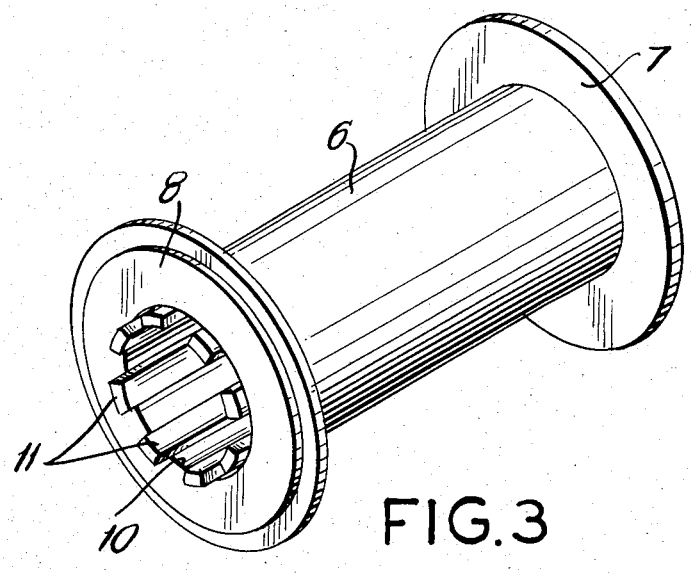

Referring to FIG. 1 of the drawing the solenoid, shown generally as 1, is located within a housing indicated symbolically at 2 filled with fluid, for example with diesel oil. The solenoid includes a U-shaped steel frame 3 made of steel stamping with oppositely disposed, turned up end pieces 4 and 5. Located between the end pieces 4,5 is a cylindrical spool-shaped bobbin 6 having opposite end flanges 7,8 and having wound thereon an electromagnetic coil 9. Bobbin 6 is preferably of non-magnetical material such as nylon with glass fiber filler. Reference to FIG. 3 shows a perspective view of the bobbin to define a cylindrical central passage 10 with longitudinal circumferentially spaced flutes 11 extending through the passage for a purpose later to be described.

Figure 2:
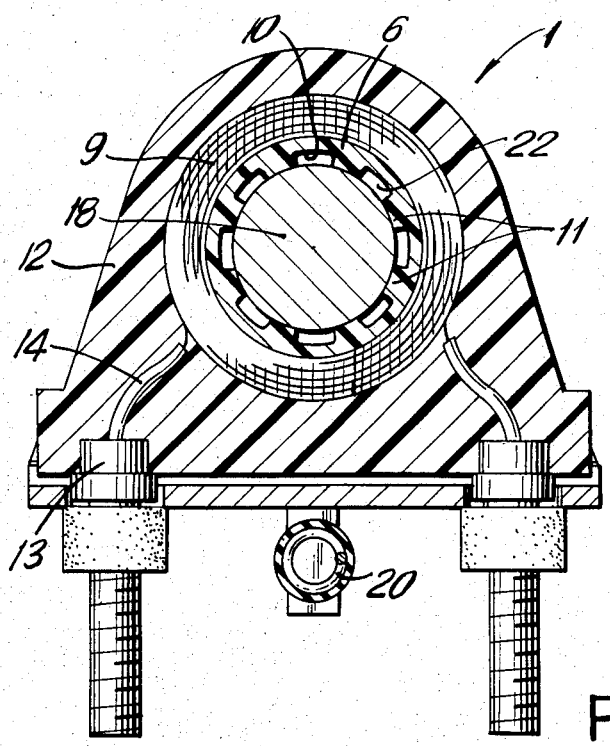

The bobbin 6 and coil 9 are encased in insulating potting plastic material 12, such as "Polyset 707" or Polyset 115, manufactured by Morton Thiokol, Inc., in order to protect the coil and give rigidity to the bobbin and coil. As shown in FIG. 2, the potting material 12 extends outward at the base of the solenoid to enclose electrical terminals 13, which are connected to the solenoid coil by leads 14.

Referring to FIG. 1 of the drawing a stationary cylindrical magnetic core piece 15 is disposed within the opening 10 along flutes 11 and extends partially through the bobbin central passage. The end of the core piece is of reduced diameter and adapted to pass through a hole in the end frame 4, so that it may be attached by upsetting the end as indicated at reference 16. A spacer washer member 17 with spaced protruding members **17*a* locates the core piece 15 and spaces the bobbin 6** with respect to the frame end piece 4 to provide transverse flow passages.

A cylindrical armature 18 is adapted to slide within the opening 10 of the bobbin slidably supporting on the flutes 11, to and from the core piece 15. The end of the armature is conical as shown at 18*a* and there is a corresponding conical seat 15*a* in the end of the core piece to receive the end of the armature. The exterior end of the armature includes a groove 18*b* coooperating with a spring loaded lever 19. Lever 19 is connected by means (not shown) to actuate the diesel fuel shutoff valve. Spring 20 cooperating with lever 19 biases the armature 18 to the position shown when the solenoid is inactive.

A variable volume chamber 21 exists between the armature 18 and core 15 when the armature is withdrawn by the spring and the coil is not activated. Chamber 21 is of minimum volume when the armature has moved to the right.

Reference to FIG. 2 of the drawing shows that the flutes 11 define longitudinal passages 22 between them. The passages 22 communicate with chamber 21 and extend along the enclosed length of the armature, as well as along the enclosed length of the core piece 15, and open out at either end of the solenoid into the fluid filled enclosure 2.

OPERATION OF THE INVENTION

When the solenoid coil 9 is activated, a magnetic field is established. Due to the field, there is a tendency for magnetic particles in the vicinity of the solenoid at either end thereof to migrate into the space between the bobbin and armature and to collect in chamber 21 between the armature and core. In the prior art, there has been an attempt to prevent such entry by using close clearances and using sealing washers around the entrances. In the present invention, however, the longitudinal flutes along the bobbin provide longitudinal passages opening in either direction from the center of the solenoid. As the coil is activated, and the armature 18 moves rapidly toward the magnetic core piece 15 in a known manner, the fluid filling chamber 21 between faces 18*a* and 15*a* is rapidly expelled and forced in either longitudinal direction out through the passages 22 between the flutes as indicated by the arrows. The spacers 17*a* at one end of the solenoid allow the transverse flow of fluid between end piece 4 and the bobbin. This serves to provide forced fluid flow in either direction from the center of the solenoid against the migration of magnetic particles into the solenoid and also continuously flushes out any contaminants and debris.

Since the bobbin is made of plastic nonmagnetic material, the flutes 11 do not substantially distort the distribution of the magnetic flux in the air gap between the magnetic armature, magnetic core, and the coil. Also, they facilitate ease of sliding movement of the armature on low friction surfaces of the flutes, and provide space between them for particles or debris. The size and shape of flutes 11 and the passages 22 between them can be varied to suit the application and adjust the velocity of the fluid flushing action as the armature moves.

When the coil is de-energized, armature 18 is returned by spring action, and while there is some tendency toward flow imwardly, there is at the same time no magnetic field drawing magnetic particles toward the interior of the solenoid.

MODIFICATION

Figure 4:
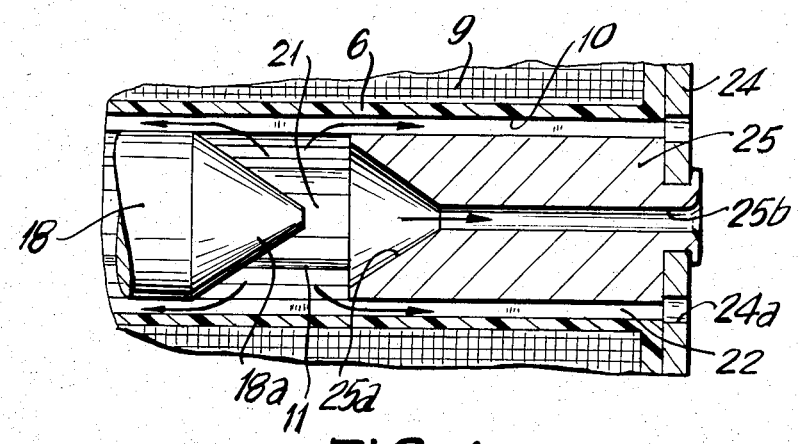

A modified form of the invention is shown in FIG. 4. There, the frame end piece, shown as 24, corresponds to end piece 4 of FIG. 1, except it is provided with openings 24*a* aligned with passages 22. The end piece 24 is in contact with the bobbin, rather than spaced from it. A core piece 25 (corresponding to core piece 15 shown in FIG. 1) includes a central hole 25*b* providing additional egress of fluid and particles from conical seat 25*a* through the center of the core piece. This modification may provide improved flushing of debris from the chamber 21 when the solenoid is located in a vertical position, where it would otherwise tend to accumulate more debris in the conical seat 25*a*.

While there has been described herein what is considered to be the preferred embodiment of the invention and one modification thereof, it is desired to secure in the appended claims all such modifications as fall within the true spirit and scope of the invention.

I claim:

1. In a solenoid adapted to be immersed in a fluid containing magnetic contaminants, said solenoid including a frame having two longitudinally spaced ends, a bobbin of non-magnetic material disposed between said frame ends, said bobbin having a central longitudinal passage, an electromagnetic coil wound on said bobbin, a magnetic more piece attached to one of said frame ends and extending partially through the bobbin central longitudinal passage, and an armature extending through the other frame end and movable within said bobbin central longitudinal passage to and from the core piece and defining a variable volume fluid chamber between the armature and core piece, the improvement comprising:

a plurality of longitudinal, circumferentially spaced flutes in the bobbin central passage defining a plurality of longitudinal passages open at either end of the bobbin, said passages communicating with said variable volume fluid chanber defined between the armature and the core piece, whereby energization of said coil moves said armature toward said core to reduce the volume of said chamber and expel fluid from said chamber and through said longitudinal passages to prevent entry of magnetic contaminants.

2. The improvement according to claim 1, wherein at least one of said frame end pieces is longitudinally spaced from said bobbin to define transverse passages communicating with said bobbin longitudinal passages, whereby fluid is expelled transversely between a frame end piece and the bobbin when the coil is energized.

3. The improvement according to claim 1, wherein said core defines a longitudinal core passage communicating with said variable volume chamber, and wherein one of said frame end pieces defines openings aligned with said bobbin longitudinal passages, whereby fluid is expelled longitudinally in either direction when the coil is energized.

4. The improvement according to claim 1, wherein said bobbin is made of glass fiber filled nylon, and wherein said flutes have inner surfaces slidably supporting the armature at a plurality of circumferentially spaced locations, to reduce sliding friction and provide space therebetween for contaminating particles or debris.

5. The improvement according to claim 1, wherein said solenoid is immersed in diesel oil, which surrounds said solenoid and communicates with both ends of said bobbin longitudinal passages.

6. The improvement according to claim 1, wherein said armature and said core piece respectively define a conical end and a conical seat on either side of said variable volume fluid chamber.

* * * * *